US005334797A

United States Patent [19]

Niedge

[11] Patent Number: 5,334,797

[45] Date of Patent: Aug. 2, 1994

[54] WIND POWERED MUSIC MACHINE

[76] Inventor: Brian L. Niedge, 1113 S. Cale, Miles City, Mont. 59301

[21] Appl. No.: 955,031

[22] Filed: Oct. 1, 1992

[51] Int. Cl.[5] ..... G10F 1/06

[52] U.S. Cl. ..... 84/95.1; 84/86

[58] Field of Search ..... 84/86, 95.1, 95.2, 96

[56] References Cited

U.S. PATENT DOCUMENTS

| | | | |
|---|---|---|---|
| 1,881,299 | 6/1931 | Savidge | 84/95.1 |
| 3,651,731 | 3/1972 | Horta | 84/95.2 |
| 4,872,387 | 10/1989 | Melia | 84/95.2 |

*Primary Examiner*—Michael L. Gellner
*Assistant Examiner*—P. Stanzione
*Attorney, Agent, or Firm*—Jacobson, Price, Holman & Stern

[57] ABSTRACT

A wind driven music machine for the reproduction of a variety of musical compositions including a vertically positioned frame supported for pivotal movement about a vertical axis. The frame includes a plurality of tuned chime tubes vertically suspended top and bottom therein. A propeller is rotatably mounted on the frame and drives a hollow cylindrical drum about a horizontal axis. As the cylindrical drum rotates, a plurality of interchangeable pegs mounted thereon, engage, depress and release a plurality of corresponding pivotal hammers for striking the correct chime tubes in the correct sequence to produce a desired song. A wind vane is mounted on the frame to direct the propeller continuously into the prevailing wind.

13 Claims, 6 Drawing Sheets

| | | | |
|---|---|---|---|
| 1 | F,J,M | 17 | F,J |
| 2 | F | 18 | F |
| 3 | H | 19 | H |
| 4 | J | 20 | J |
| 5 | F | 21 | K |
| 6 | J | 22 | J |
| 7 | H | 23 | H |
| 8 | A | 24 | F |
| 9 | F,J | 25 | E |
| 10 | F | 26 | A |
| 11 | H | 27 | C |
| 12 | J | 28 | E |
| 13 | F | 29 | F |
| 14 | ● | 30 | ● |
| 15 | E | 31 | F,J,M |
| 16 | ● | 32 | ● |

WIND POWERED MUSIC MACHINE

BACKGROUND OF THE INVENTION

1. Field of the Invention

A wind powered music machine including a frame supported for pivotal movement about a vertical axis with a wind driven propeller rotatably mounted on the frame for rotation about a horizontal axis with the frame including a vane to pivot the frame about its vertical axis to orient the propeller in facing relation to wind direction. A plurality of chime members are supported vertically in the frame from their upper and lower ends and a plurality of gravity operated hammers are pivotally supported from the frame in alignment with the chime members for movement between a position spaced from the chime members and a position striking the chime members. A cylindrical member is supported on the frame and driven from the propeller with the cylindrical member including pegs which engage the gravity operated hammers to lift and release the hammers. The pegs are arranged in selected patterns to enable a song to be played when the propeller is driven by the wind.

2. Description of the Prior Art

Various music box devices which include a rotatable drum with pins to produce a sequence of sounds are generally well known as are wind driven devices. The prior art relevant to this invention includes the following U.S. Pat. Nos.:

2,812,680
3,362,102
3,517,635
3,651,731
4,469,003

The above patents, known to Applicant, do not include the specific structure of the wind driven cylindrical member with pegs thereon engaging a plurality of hammers associated with chime members in the manner disclosed in this invention.

SUMMARY OF THE INVENTION

An object of the present invention is to provide a wind powered music machine including a frame that is supported for pivotal movement about a vertical axis and which has a propeller rotatably supported thereon for rotation about a horizontal axis and a vane to maintain the propeller in facing relation to the wind direction together with a mechanism associated with and being driven by the propeller and actuating a plurality of hammers in functional association with a plurality of chime members to produce a sequence of sounds or musical notes to produce a song.

Another object of the invention is to provide a wind powered music machine in accordance with the preceding object in which the chime members are vertically oriented and supported at the upper and lower ends from the frame and arranged in two laterally spaced rows of tubular chime members which are arranged with the individual tubular chime members being spaced to enable access to one row of tubular chime members by hammers extending between the tubular chime members in the other row of tubular chime members.

A further object of the invention is to provide a wind powered music machine including a cylindrical drum with projecting pegs arranged thereon in preselected musical producing patterns which are positioned to engage the hammers in a selected sequence for lifting and dropping the hammers by gravity to engage the chime members to produce a song when the propeller is driven by the wind.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
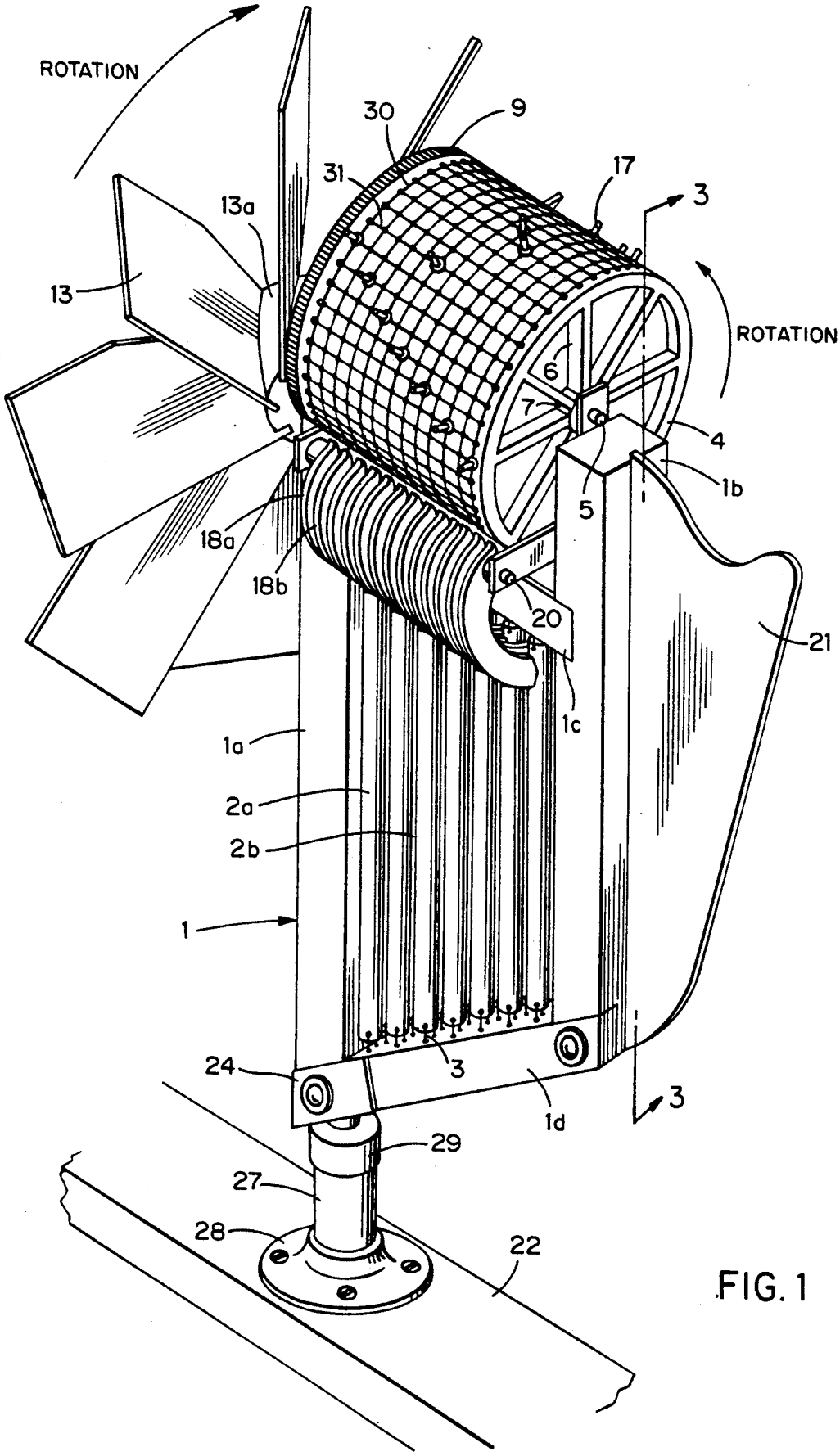
FIG. 1 is a perspective view of the wind powered music machine of this invention.
Figure 2:
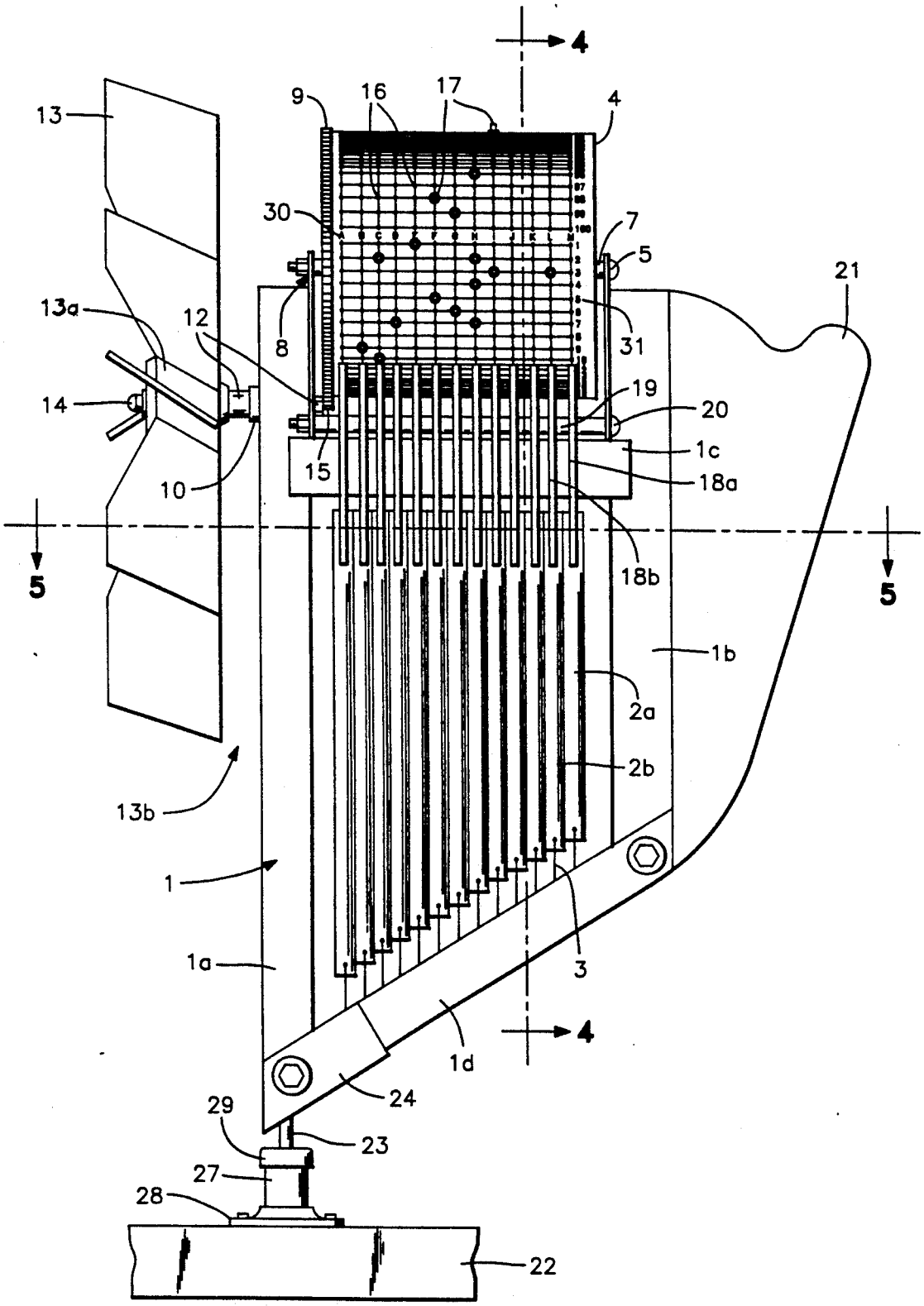
FIG. 2 is a side elevational view of the invention.
Figure 3:
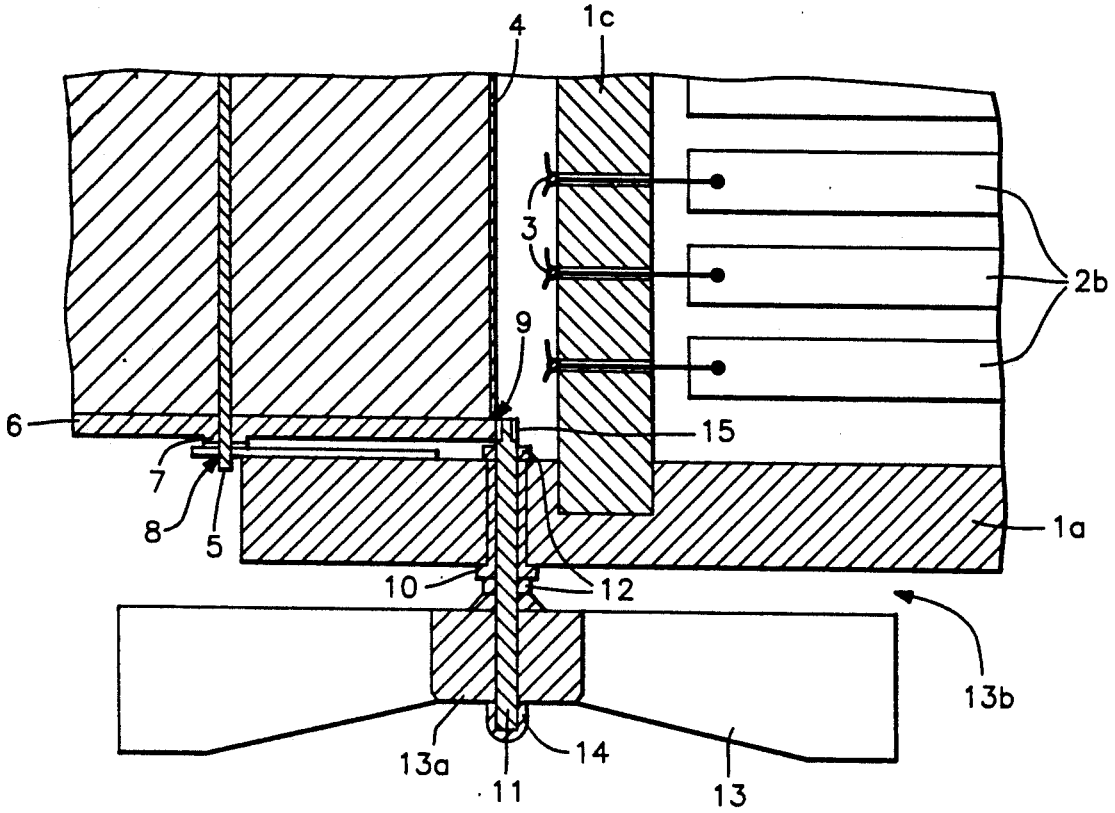
FIG. 3 is a fragmental sectional view taken along section line 2—2 on FIG. 1 illustrating the drive connection between the propeller shaft and cylindrical drum.
Figure 4:
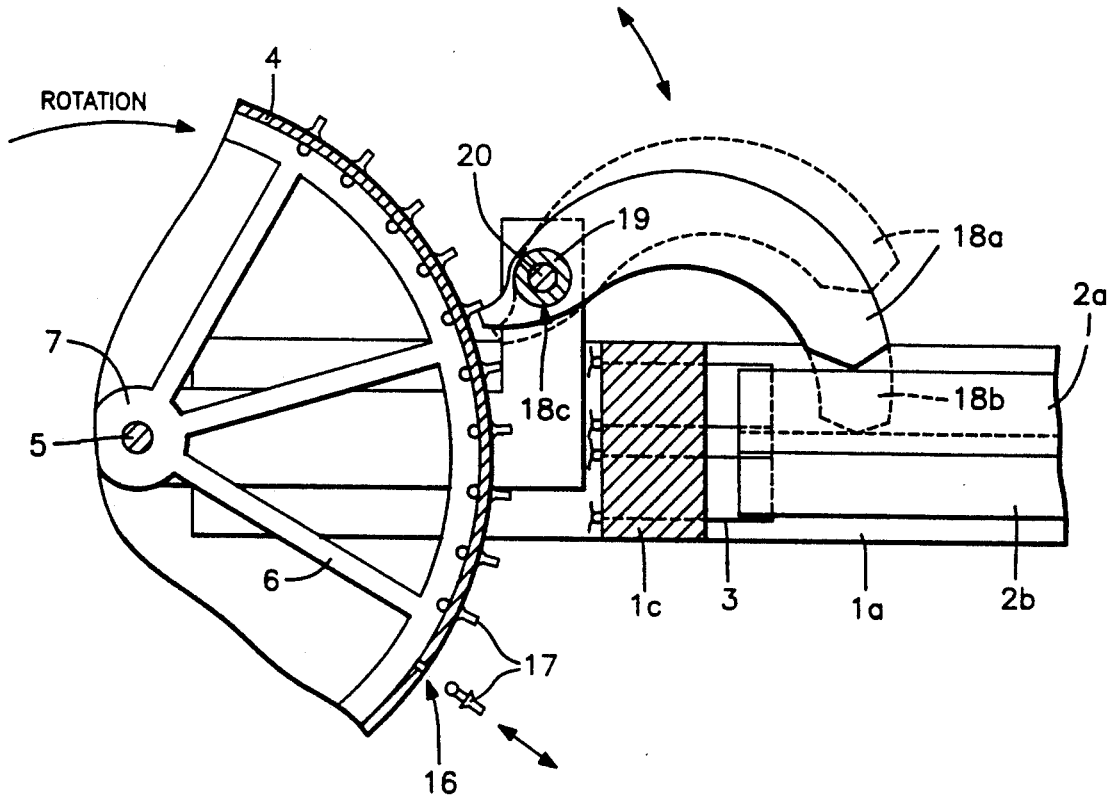
FIG. 4 is a fragmental sectional view taken along section line 4—4 on FIG. 2 illustrating the association between the cylindrical drum, hammers and chime members.
Figure 5:
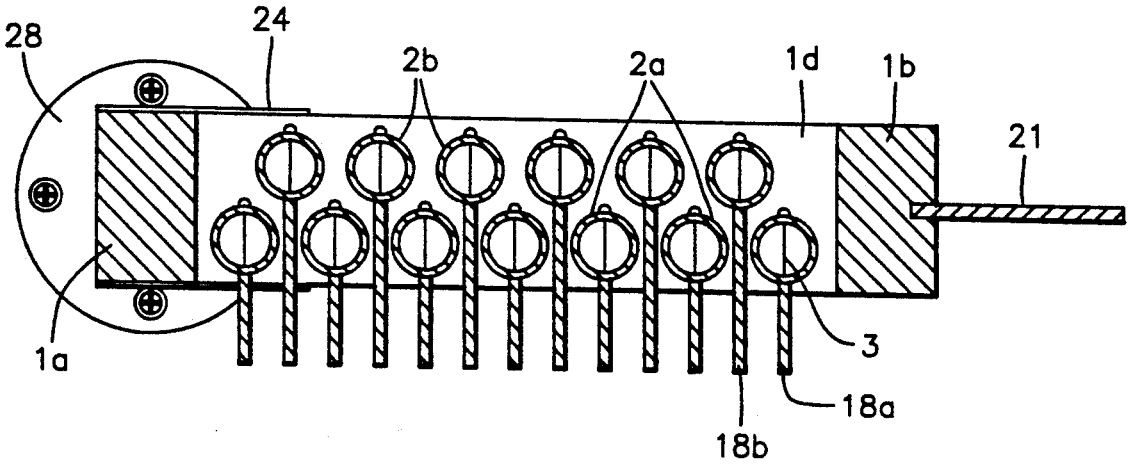
FIG. 5 is a fragmental sectional view taken along section line 5–5 on FIG. 2 illustrating the staggered relation of the chime members and hammers.

FIGS. 1–6 and 8 illustrate the wind powered music machine of the present invention which includes a vertically positioned framework 1 which consists of a longer vertical member 1*a*, a shorter vertical member 1*b*, an upper horizontal cross-piece 1*c* and a lower diagonal cross-piece 1*d*. A plurality of chime tubes or acoustic members 2*a* & 2*b* are vertically suspended from the framework at their top and bottom by means of tied wire or line 3. The chime tubes are tuned by exact length as musical instrument members; C, C#, D, Eb, E, F, F#, G, G#, A, Bb, B, C, etc. and graduating from lower note pitch symmetrically up to higher note pitch. The chime tubes are aligned in two rows; a front row 2*a* and a back row 2*b* and in a staggered or offset configuration effectively exposing frontal access to the back row of chime tubes.

A hollow rotatable cylindrical body or drum 4, it's axis being horizontally disposed and perpendicular to said chime tubes, is held fast to an axial shaft 5 by means of a spoke-work 6 and small hub 7 at each end of the cylindrical drum. The axial shaft rotates in two bearings 8 mounted atop said framework. The periphery of one end of said cylindrical drum has a ring gear 9 fixed thereto.

The upper portion of said longer vertical framework member 1*a* is provided with a fixed bearing 10 through which a rotary shaft 11 turns, being held in position by means of common threaded nuts 12. The axis of shaft 11 is directly below and parallel with the rotational axis of the cylindrical drum 4.

A propeller 13, of adequate size to power said machine in light wind is removably secured to said rotary shaft 11 by means of a threaded flange nut 14 tightened on the propeller hub 13*a*. Ample clearance is maintained between the propeller blades 13*b* and framework member 1*a* to allow unhindered rotation of the propeller.

Fixed to the opposing end of the rotary shaft 11 is a pinion gear 15 engaging and counter-rotating ring gear 9 fixed to cylindrical drum 4 to enable wind acting on the propeller to drive this described mechanism by slowly rotating the cylindrical drum in the correct direction.

Equally spaced around the periphery of said cylindrical drum 4 are a plurality of identical rows of small equally spaced holes 16, each row being in vertical alignment with its respective chime tube axis. Inserted into the holes in a predetermined and changeable musical pattern are a plurality of small identical snap-in type pegs 17 that can easily be inserted or removed.

As the cylindrical drum 4 rotates, the small pegs projecting radially from and mounted thereon, engage, depress and disengage the upper ends of a plurality of lever hammers 18*a* & 18*b*, thereby causing the lower ends of said lever hammers to rise and fall, because of gravity, striking the correct chime tubes in the correct sequence, thus producing the desired song. The lever hammers are of a general crescent or dolphin shape and are pivoted at their upper mid portions 18*c* while being held in alignment by spacers 19 with respective pegs and chime tubes on a common rod 20 mounted on the framework. The common rod 20 is parallel with the axis of cylindrical drum and adjacent to the lower periphery of the cylindrical drum and the upper portion of the chime tubes.

This machine employs two different sizes of lever hammers; a short type 18*a* for striking the front row of chime tubes 2*a* and a long type 18*b* for striking the back row of chime tubes 2*b*. For the back row chime tubes to be struck, producing the desired musical tones, the long type lever hammer 18b must pass unhindered between the front row chime tubes. The distance from the axis of the cylindrical drum to the upper ends of all the lever hammers is the same.

Fixed to the shorter vertical framework member is a vertically positioned directional vane 21 which functions in a known manner to direct the propeller continually into the prevailing wind.

The machine is mounted to a firm level mounting surface 22 by means of a vertically disposed pivotal shaft 23 fixed to a bracket 24 which is secured to the bottom portion of the longer vertical frame member 1*a*. The shaft 25 is inserted into and easily removable from an upper bearing 25 and a lower bearing 26 which are firmly mounted to a vertically positioned fixture 27. The fixture 27 is attached to a mounting base plate 28 which is secured to the firm level mounting surface 22. This mounting base assembly provides unhindered three hundred sixty degree pivotal rotation to said machine and ease of removal of said machine from said mounting base in the event of inclement weather.

A cap or cover 29 is fixed around the upper portion of the pivotal shaft 23 and acts as a rain cap protecting the bearings from rust caused by rain or moisture.

Figure 7:
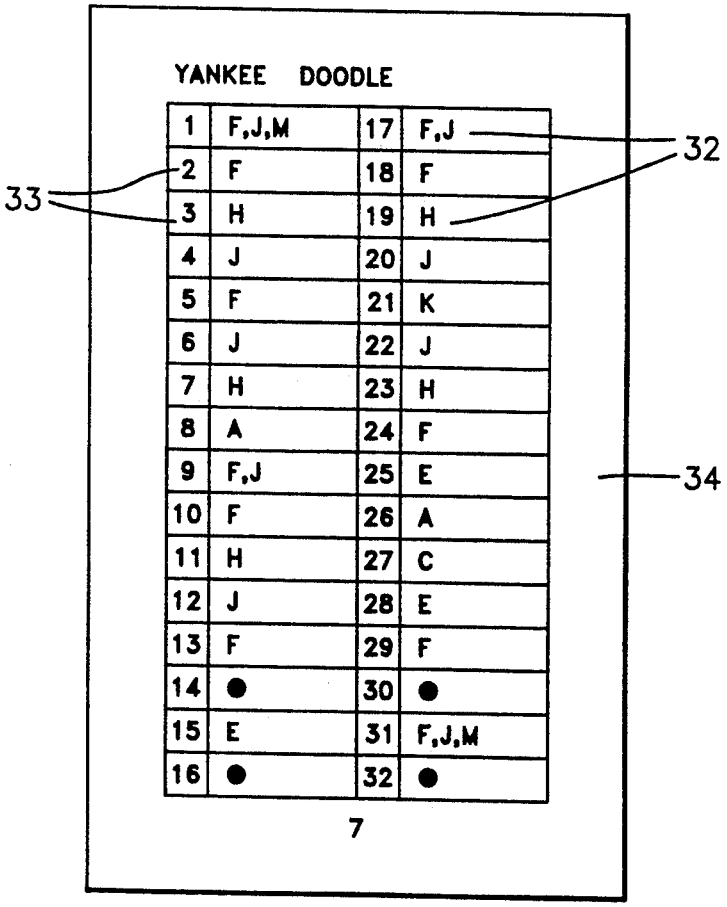
FIG. 7 is a plan view illustrating an example of a song book showing peg location coordinates for a particular song.
Figure 6:
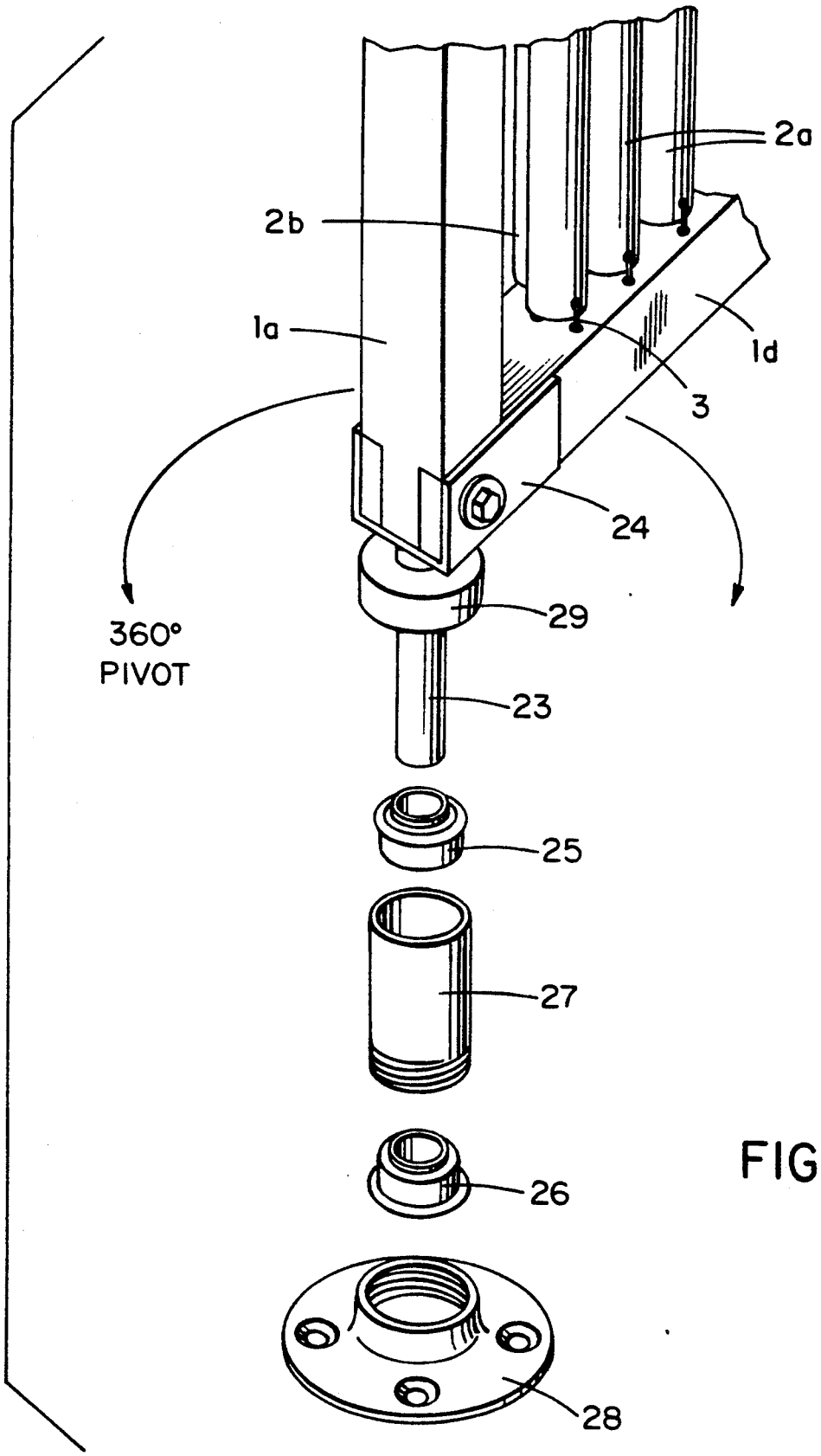
FIG. 6 is a fragmental exploded perspective view of the lower corner portion of the frame and its supporting structure.

In order for the user of the machine to more easily determine the correct peg location coordinates on the cylindrical drum 4 to render a given musical composition, a series of longitudinal lines designated by letters 30 and transverse lines designated by numerals 31 are embossed or inscribed upon the periphery of the cylindrical drum in correct alignment with the small peg location holes 16 therein. The letters 30 and numerals 31 correspond with like letters 32 and numerals 33 shown as coordinates in the song-book coordinate list 34 which accompanies the machine as illustrated in FIG. 7. The song-book coordinate lists show the necessary peg placement coordinates to play a variety of songs.

The cylindrical drum 4 is hollow with a spoke-work 6 and small hub 7 attached to each end which allows wind to pass through the cylindrical drum relatively unhindered. The employment of a hollow rotatable cylindrical drum substantially larger in diameter and of length will not substantially hinder air flow through the propeller blades. This advantage allows a greater circumference around the cylindrical drum, thereby, allowing a greater number of peg location placement holes per row around the cylindrical drum, thereby, allowing a lengthier song to be played.

Figure 8:
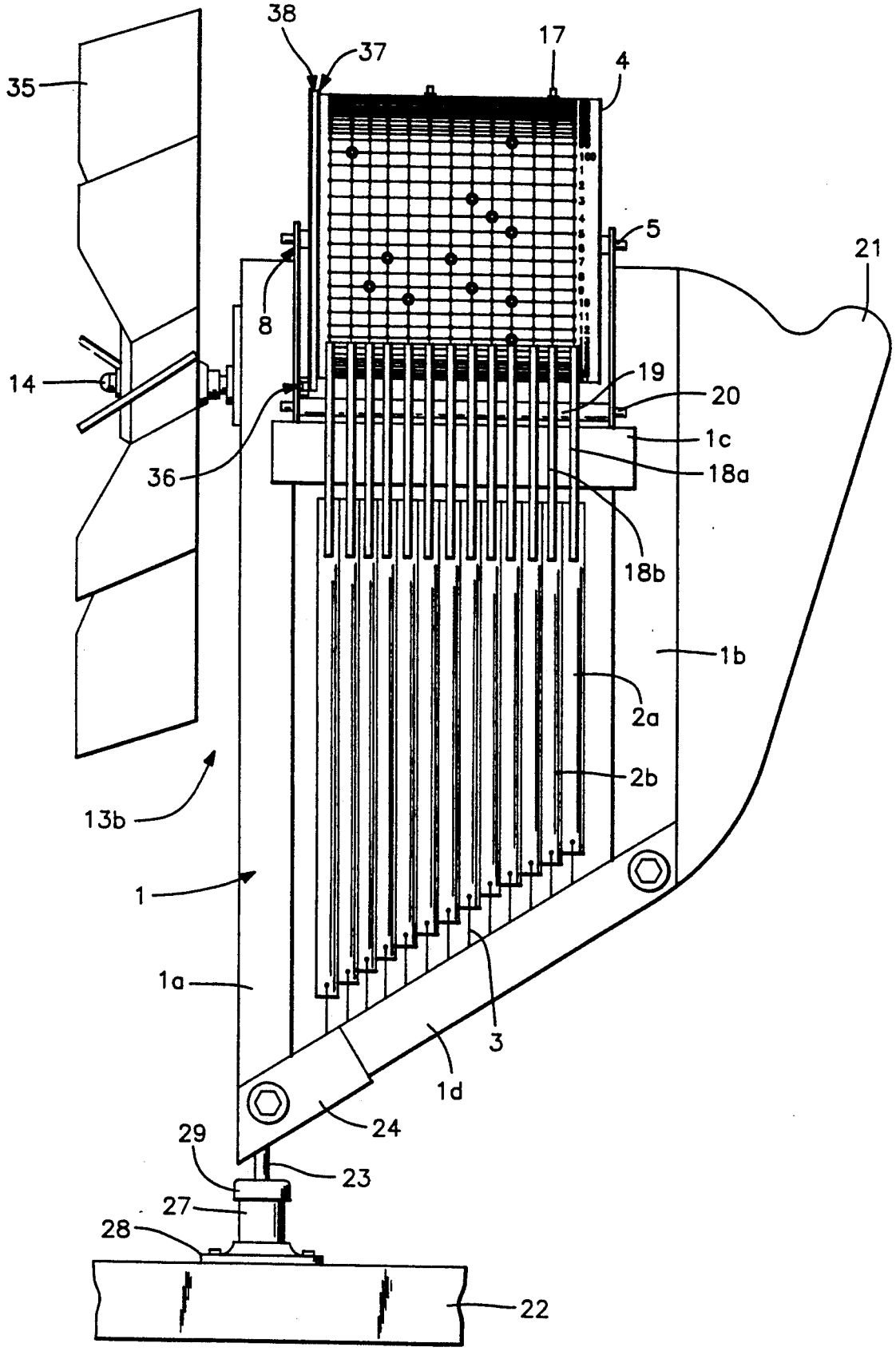
FIG. 8 is a side elevational view of the wind powered music machine similar to FIG. 2 but illustrating a belt drive arrangement for the cylindrical drum.

The machine may be configured with a known belt and pulley drive mechanism, (see FIG. 8). This version utilizes a propeller 35 which rotates in the opposite direction of the aforesaid propeller 13. A small pulley 36, large pulley 37 and a rubber belt 38 engaging said pulleys is an alternative drive mechanism replacing the small pinion gear 15 and large ring gear 9 utilized in the aforesaid gear driven machine. This belt drive configuration results in like rotation of the propeller 35 and cylindrical drum 4.

As the wind blows, the machine pivots itself into the wind with the aid of it's directional vane and pivotal mounting base assembly. The wind drives the propeller which then by means of gears or pulleys, rotates a cylindrical drum, the axis of which is horizontal, mounted atop a framework having an array of tuned chime tubes vertically suspended, top and bottom therein.

As the cylindrical drum rotates, small pegs protruding from it engage, and depress the top ends of lever hammers, mounted on a common rod, thereby, lifting the bottom end of said lever hammers. As said pegs pass in their rotation, said pegs release the lever hammers allowing them to fall, striking the correct chime tubes in the correct sequence, thereby, producing the desired musical tones.

The pegs are snapped into the cylindrical drum in a preset musical pattern that can easily be changed. Also, the cylindrical drum contains all of the necessary peg location holes needed to play the songs found in the accompanying song-book.

The song-book contains a variety of songs which are in the form of coordinate lists. Each coordinate list shows the necessary peg location coordinates needed to play a song. These coordinates correspond with longitudinal and transverse coordinate lines and legends found on the cylindrical drum.

The wind powered music machine can be placed almost anywhere outdoors where a little breeze can drive it, preferably on a post near a garden or on a porch or deck railing.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A wind powered music machine comprising a vertically positioned framework consisting of a longer vertical member, a shorter vertical member, an upper horizontal cross-piece and a lower diagonal cross-piece, a plurality of chime tubes, being tuned to the musical scale, vertically suspended top and bottom in said frame, a hollow rotatable cylindrical body, the axis of which is horizontally disposed, mounted by means of a spoke-work and small hub at each end, held fast to an axial shaft, which rotates in two bearings fixed atop said framework, a propeller of adequate size to power said machine, being driven by the wind, fixed to a rotary shaft which rotates in a bearing mounted to said framework, the axis of said rotary shaft being parallel with the axis of said cylindrical body, a small pinion gear on said shaft, engaging and counter-rotating a large ring gear fixed to one end of said cylindrical body, thus, slowly rotating said cylindrical body in the correct direction, a plurality of small pegs mounted on said body in a predetermined pattern and held in a plurality of small peg location holes equally spaced around the periphery of said cylindrical body, a plurality of lever hammers mounted on said frame for engagement by said pegs to depress and release the upper ends of said hammers, thereby causing the lower ends of said lever hammers, to lift and fall because of gravity, striking the correct chime tube in the correct sequence, thus, producing the desired musical tones, said lever hammers being equally spaced upon a common rod mounted parallel with the axis of said cylindrical body, to said framework, said common rod being convenient to the lower periphery of said cylindrical body and the upper portion of said chime tubes with continual accurate alignment of said peg location holes, pegs, lever hammers and chime tubes, respectively, being essential for correct operation of the machine.

2. A wind powered music machine as claimed in claim 1 wherein said framework has a wind directing vane attached thereon for directing said propeller into the prevailing wind.

3. A wind .powered music machine as claimed in claim 1 wherein said machine is mounted in a vertical position to a firm level surface by means of a vertically disposed pivotal shaft fixed to the bottom portion of said longer vertical frame member, said shaft being inserted into and easily removable from an upper bearing and a lower bearing, said bearings being mounted to a vertically positioned fixture, said fixture being attached to a mounting base plate, said base plate being secured to a firm level mounting surface whereby the pivotal mounting base assembly allows said machine to freely pivot three hundred sixty degrees.

4. A wind powered music machine as claimed in claim 3 wherein a cover is fixed around the upper end of said vertical pivotal shaft to act as a rain cap, effectively protecting said upper and lower bearings from rust due to rain or moisture.

5. A wind powered music machine as claimed in claim 1 wherein two separate rows of tuned chime tubes are vertically suspended, top and bottom, within said framework in a front row and a back row, said back row being staggered in relation to said front row, said staggered configuration of said chime tubes permitting frontal access by said lever hammers to strike said back row of chime tubes thereby reducing the length of said machine and many of its related parts and substantially reducing the cost of producing such machines.

6. The wind powered music machine as claimed in claim 5 wherein said machine employs two differing sizes of a plurality of said lever hammers, a short lever hammer for striking said front row of chime tubes and a long lever hammer for striking said back row of chime tubes, said long lever hammers passing unhindered between said front row chime tubes to successfully strike said back row chime tubes, thereby, producing the desired musical tones.

7. A wind powered music machine as claimed in claim 1 wherein said rotatable cylindrical body is hollow and has said mounting spoke-work and small hub attached to each end thereof and held fast to an axial shaft and being mounted in two bearings atop said framework for the purpose of rotation thereon, effectively allowing wind to act on said propeller blades and then flow through said cylindrical body relatively unhindered thereby allowing a greater number of said small pegs to be employed, thereby, allowing a lengthier song to be played while permitting more efficient operation of said propeller than would otherwise be permitted.

8. A wind powered sound producing machine comprising a frame, means supporting said frame for pivotal movement about a vertical axis, a wind driven propeller mounted on said frame for rotation about a horizontal axis, vane means on said frame for pivoting the frame about its vertical axis to orient said propeller in facing relation to wind direction for driving said propeller, a driven shaft rotatably supported on said frame, said propeller being drivingly connected to said shaft, a plurality of chime members vertically mounted on said frame, a corresponding number of hammers movably mounted on said frame in alignment with said chime members for movement between a position spaced from said chime members and a position in striking engagement with said chime members to produce sounds, and means drivingly connected to said driven shaft for moving said hammers into spaced relation to the chime members and releasing said hammers for movement into striking engagement with said chime members, said chime members being arranged in two parallel, spaced rows with the chime members in each row being spaced from each other and the chime members in one row being staggered in relation to the chime members in the other row thereby providing access to both rows of said chime members, each of said chime members having a hammer aligned therewith for striking engagement with the alternate hammers passing between the chime members in the row proximal the hammers to engage the chime members in the row distal from the hammers thereby enabling a larger number of hammers and chime members to be arranged in minimum space requirements.

9. The machine as defined in claim 8 wherein said hammers are supported from the frame for movement by gravity into striking engagement with the chime members, said means drivingly connected to said driven shaft for moving said hammers into spaced relation to the chime members and releasing said hammers for movement into striking engagement with said chime members including a cylindrical drum rotatably about an axis parallel to said hammers, said drum being drivingly connected to said driven shaft and including a plurality of longitudinally spaced outward projections on the drum to engage said hammers for moving said hammers into spaced relation to the chime members and releasing said hammers when the projections move in an arcuate path about the axis of rotation of the drum to enable the hammers to move by gravity into striking engagement with the chime members.

10. The machine as defined in claim 9 wherein said hammers are pivotally supported from said frame for pivotal movement about an axis parallel to the rotational axis of said drum, the pivotal axis of said hammers being oriented adjacent one end thereof with the proximal end of the hammers being engaged by the projections on the drum and the distal end of the hammers striking the chime members when the hammers are released, said chime members being elongated tubular members supported from said frame from at least the upper end thereof to produce a plurality of sounds when struck by the hammers with the sequence of chime members being struck by the hammers being determined by the arrangement of the projections on said drum, said projections on the drum being selectively placed thereon to enable different sound sequences to be produced.

11. The machine as defined in claim 10 wherein said driven shaft is parallel to the rotational axis of the drum and is drivingly connected thereto by a pinion gear on the shaft and a ring gear on the drum.

12. The machine as defined in claim 10 wherein said driven shaft is supported from the frame in parallel relation to the axis of rotation of the drum, said driven shaft being connected to the drum by pulleys and a drive belt encircling the pulleys.

13. The machine as defined in claim 10 wherein said chime members are suspended from said frame at the upper and lower ends thereof.

* * * * *